US009318046B2

(12) United States Patent
Xie

(10) Patent No.: US 9,318,046 B2
(45) Date of Patent: Apr. 19, 2016

(54) POWER SUPPLY CIRCUIT AND DISPLAY APPARATUS

(71) Applicant: BOE TECHNOLOGY GROUP CO., LTD., Beijing (CN)

(72) Inventor: Hongjun Xie, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 106 days.

(21) Appl. No.: 14/241,638

(22) PCT Filed: Jun. 5, 2013

(86) PCT No.: PCT/CN2013/076804
§ 371 (c)(1),
(2) Date: Feb. 27, 2014

(87) PCT Pub. No.: WO2014/172961
PCT Pub. Date: Oct. 30, 2014

(65) Prior Publication Data

US 2014/0313182 A1 Oct. 23, 2014

(51) Int. Cl.
*G09G 3/32* (2006.01)

(52) U.S. Cl.
CPC ..... *G09G 3/3225* (2013.01); *G09G 2330/025* (2013.01); *G09G 2330/06* (2013.01)

(58) Field of Classification Search
CPC ..... G05F 3/30; G09G 2330/021; G09G 2330/025; G09G 2330/06; G09G 3/3225
See application file for complete search history.

(56) References Cited

U.S. PATENT DOCUMENTS 7,969,211 B2 * 6/2011 Huang ..... 327/143
8,909,958 B2 * 12/2014 Schindler ..... 713/320

(Continued)

FOREIGN PATENT DOCUMENTS

CN 1599524 A 3/2005
CN 1988321 A 6/2007

(Continued)

OTHER PUBLICATIONS

First Office Action issued by the Chinese Patent Office for Chinese Patent Application No. 201310141442.3 dated Sep. 17, 2014, 10pgs.

(Continued)

*Primary Examiner* — Abbas Abdulselam

(57) ABSTRACT

A power supply circuit and display apparatus, comprising power source (1), charging/discharging module (2), detecting module (3), the detecting module detects detecting parameter on power-supply path, feeds back corresponding mode signal to the power source according to the detected detecting parameter, and outputs preset operation voltage to load (4); the power source receives the mode signal fed back from the detecting module, outputs power supply voltage corresponding to the mode signal, and charges the charging/discharging module when the mode signal is the low power signal; and the charging/discharging module is discharged to the detecting module when the power source outputs the supply voltage corresponding to the high power signal, and is charged when the power source outputs the supply voltage corresponding to the low power signal. The circuit can avoid effectively that the consumption of the power source fluctuates significantly with the power consumption changing of the load thereby the power source operates stably.

20 Claims, 4 Drawing Sheets

(56) References Cited

U.S. PATENT DOCUMENTS

| | | | | |
|---|---|---|---|---|
| 8,952,670 | B2 * | 2/2015 | Huang | H02M 3/158 323/276 |
| 2005/0243032 | A1 | 11/2005 | Lee | |
| 2009/0001935 | A1 | 1/2009 | Odaohhara | |

FOREIGN PATENT DOCUMENTS

| | | | |
|---|---|---|---|
| CN | 101335461 | A | 12/2008 |
| CN | 202872411 | U | 4/2013 |

OTHER PUBLICATIONS

English translation of First Office Action issued by the Chinese Patent Office for Chinese Patent Application No. 201310141442.3 dated Sep. 17, 2014, 13pgs.

PCT Written Opinion of International Searching Authority (Chinese language), in International Application No. PCT/CN2013/076804, dated Jan. 30, 2014; 3 pages.

English translation of PCT Written Opinion of International Searching Authority, in International Application No. PCT/CN2013/076804, dated Jan. 30, 2014; 3 pages.

English Language Abstract of CN1988321A; 2 pages.

Second Office Action (Chinese language) issued by the State Intellectual Property Office of People's Republic of China, in Chinese Patent Application No. 201310141442.3 dated Dec. 10, 2014, 9pgs.

English translation of Second Office Action issued by the State Intellectual Property Office of People's Republic of China, in Chinese Patent Application No. 201310141442.3 dated Dec. 10, 2014, 11pgs.

* cited by examiner

POWER SUPPLY CIRCUIT AND DISPLAY APPARATUS

CROSS REFERENCE TO RELATED APPLICATIONS

This application is based on International Application No. PCT/CN2013/076804 filed on Jun. 5, 2013, which claims priority, to Chinese National Application No. 201310141442.3 filed on Apr. 22, 2013. The entire contents of each and every foregoing application are incorporated herein by reference.

TECHNICAL FIELD OF THE DISCLOSURE

The present disclosure relates to a field of Active Matrix Organic Light-Emitting Diode (hereinafter referred to as AMOLED in brief) display technique, and particularly to a power supply circuit and a display apparatus.

BACKGROUND

Compared to a conventional Thin Film Transistor Liquid Crystal Display (referred to as TFT-LCD in brief hereinafter), an AMOLED display apparatus has many advantages and variations in application. The AMOLED display apparatus has more colorful representation and wider color gamut. Further, the AMOLED display apparatus is a self-luminescent device, and has no need for a backlight module.

FIG. 1 is a schematic diagram of a structure of an AMOLED display apparatus in the prior art. As shown in FIG. 1, the AMOLED display apparatus comprises a power source 1 and an AMOLED panel 6 connected to the power source 1. The power source 1 supplies electricity to the AMOLED panel 6 directly so that the AMOLED panel 6 can display pictures. Since the AMOLED display apparatus is a self-luminescent device, an Electroluminescence Layer (referred to as EL in short hereinafter) of the dark state region in the displayed picture has a low luminance, a small current and a low power consumption; while the EL of the light state region in the displayed picture has a high luminance, a large current and a high power consumption. When there is an (a) increase/decrease in the light state picture on the whole AMOLED display apparatus, the entire power consumption will fluctuate substantially, that is, the power consumption of the AMOLED display apparatus will fluctuate as the picture varies, and thus is unstable.

FIG. 2 is a curve diagram of power consumption of the power source 1 shown in FIG. 1. As shown in FIG. 2, the power consumption of the power source 1 in the prior art fluctuates substantially with the variation of the power consumption of the AMOLED display apparatus. On the one hand, this results in that it is hard for the power source 1 to operate stably and thus decreases the lifespan of the power source 1; and on the other hand, the power consumption changed sharply would deteriorate the Electron-Magnetic Interference (hereinafter referred to as EMI in short) characteristics of the products.

SUMMARY

The present disclosure provides a power supply circuit and a display apparatus for raising the lifespan of a power source and enhancing the EMI characteristics of a product.

According to one aspect of the present disclosure, there is provided a power supply circuit comprising a power source, a charging/discharging module, a detecting module, wherein the power source is connected to the detecting module, and the charging/discharging module is connected to the power source and the detecting module respectively; wherein:

the detecting module detects a detecting parameter on a power supply path, feeds back a corresponding mode signal to the power source according to the detecting parameter as detected, and outputs a preset operation voltage to a load, wherein the mode signal comprises a low power signal or a high power signal;

the power source receives the mode signal fed back from the detecting module, outputs a power supply voltage corresponding to the mode signal according to the mode signal, and charges the charging/discharging module when the mode signal is the low power signal; and the charging/discharging module is discharged to the detecting module when the power source outputs the power supply voltage corresponding to the high power signal, and is charged when the power source outputs the power supply voltage corresponding to the low power signal.

Optionally, the detecting module detects a detecting parameter on the power supply path, determines whether the detecting parameter is larger than a preset threshold parameter, wherein if the detecting parameter is larger than the threshold parameter, the detecting module feeds back the high power signal to the power source; if the detecting parameter is less than or equal to the threshold parameter, the detecting module feeds hack the low power signal to the power source, and the detecting module outputs the operation voltage to the load.

Optionally, the detecting module comprises a determining module and an operation voltage output module, wherein the determining module is connected to the power source, and the operation voltage output module is connected to the load;

the determining module detects the detecting parameter on the power supply path, and determines whether the detecting parameter is larger than the preset threshold parameter; if the detecting parameter is larger than the threshold parameter, the determining module feeds back the high power signal to the power source, if the detecting parameter is less than or equal to the threshold parameter, the determining module feeds back the low power signal to the power source; and the operation voltage output module outputs the operation voltage to the load.

Optionally, the determining module comprises a power resistor and a voltage difference detecting module, wherein an input terminal of the power resistor is connected to the power source, and an output terminal of the power resistor is connected to the operation voltage output module; an input terminal of the voltage difference detecting module is connected to the input terminal of the power resistor and the output terminal of the power resistor respectively, and the output terminal of the voltage difference detecting module is connected to the power source;

in the case that the detecting parameter is a current value and the threshold parameter is a threshold current, the voltage difference detecting module is operative to detect a voltage difference between the input terminal and the output terminal of the power resistor, generate the current value according to the voltage difference value and the resistance value of the power resistor, determine whether the current value is larger than the threshold current value, feeds back the high power signal to the power source if the current value is larger than the threshold current value, and feeds back the low power signal to the power source if the current value is less than or equal to the threshold current value; and as an alternative, in the case that the detecting parameter is a voltage difference value and the threshold parameter is a threshold voltage, the voltage difference detecting module is operative to detect a voltage difference value between the input terminal and the output terminal of the power resistor, determine whether the voltage difference value is larger than the threshold voltage value, feed back the high power signal to the power source if the voltage difference value is larger than the threshold voltage value, feeds back the low power signal to the power source if the voltage difference value is less than or equal to the threshold voltage value.

Optionally, when the mode signal is the low power signal, the power supply voltage corresponding to the mode signal is at a high level; and when the mode signal is the high power signal, the power supply voltage corresponding to the mode signal is at a low level.

Optionally, a difference value between the high level and the low level is 0.1V.

Optionally, when the power supply voltage is larger than a charge threshold voltage of the charging/discharging module, the power source charges the charging/discharging module; when the power supply voltage is less than the charge threshold voltage of the charging/discharging module, the power source discharges the charging/discharging module, and the charge threshold voltage of the charging/discharging module is larger than the low level and less than the high level.

Optionally, the charging/discharging module is a charging/discharging battery.

Optionally, the load comprises an AMOLED panel.

According to another aspect of the disclosure, there is provided a display apparatus comprising the above power supply circuit and the load connected to the power supply circuit.

The embodiments of the present disclosure have the beneficial effects as follows:

In the technical solutions of the power supply circuit and the display apparatus provided in the embodiments of the present invention, when the detecting module detects that the mode signal is the low power signal, the power source charges the charging/discharging module, and when the detecting module detects that the mode signal is the high power signal, the charging/discharging module is discharged to the detecting module, and the detecting module outputs the preset operation voltage to the load. It can be avoided effectively that the power consumption of the power source fluctuates significantly with the change of the power consumption of the load by means of the technical solutions, so that the power source can operate stably, thus improving the lifespan of the power source and enhancing the EMI characteristics of the product.

DETAILED DESCRIPTION

Hereinafter, detailed descriptions will be given to the power supply circuit and the display apparatus provided in the embodiments of the present invention with reference to the accompanying figures so that those skilled in the art can understand the technical solutions of the present invention better.

Figure 3:
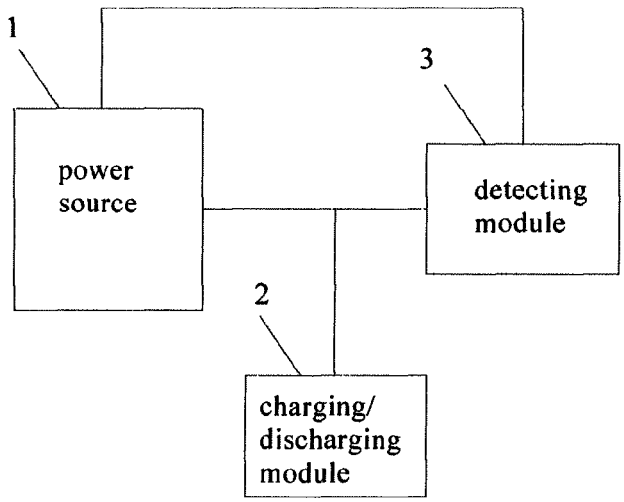
FIG. 3 is a schematic diagram of a structure of a power supply circuit according to a first embodiment of the present invention.
Figure 4:
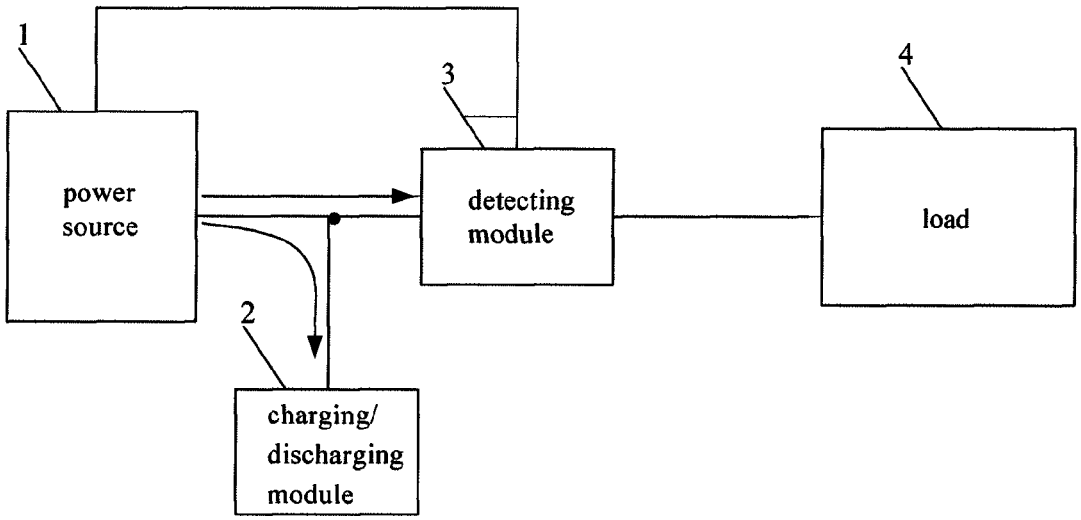
FIG. 4 is a schematic diagram of the power supply circuit shown in FIG. 3 in an operational mode.
Figure 5:
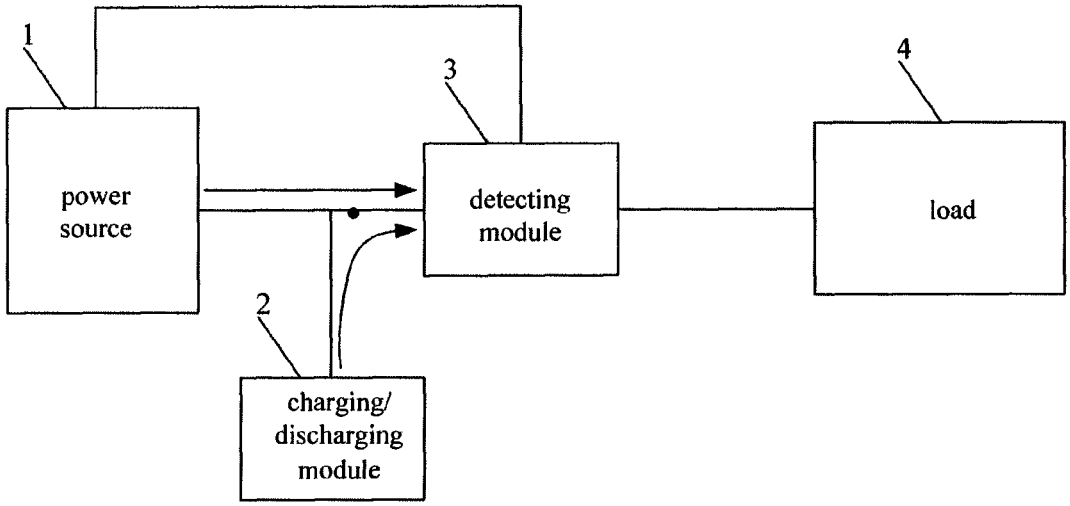
FIG. 5 is a schematic diagram of the power supply circuit shown in FIG. 3 in another operational mode.

FIG. 3 is a schematic diagram of the structure of the power supply circuit according to the first embodiment of the present invention, FIG. 4 is a schematic diagram of the power supply circuit shown in FIG. 3 in an operational mode, and FIG. 5 is a schematic diagram of the power supply circuit shown in FIG. 3 in another operational mode. As illustrated in FIGS. 3, 4 and 5, the power supply circuit comprises a power source 1, a charging/discharging module 2 and a detecting module 3, wherein the power source 1 is connected to the detecting module 3, and the charging/discharging module 2 is connected to the power source 1 and the detecting module 3 respectively.

The detecting module 3 detects a detecting parameter on a power supply path, feeds back a corresponding mode signal to the power source 1 according to the detecting parameter as detected, and outputs a preset operation voltage to a load 4, wherein the mode signal can comprise a low power signal or a high power signal. The low power signal represents that the power supply circuit enters a low power mode, and the high power signal represents that the power supply circuit enters a high power mode, for example, the low power signal can be at a low level, and the high power signal can be at a high level. In an embodiment of the present invention, the load 4 can be an AMOLED panel, and the AMOLED panel can display a picture based on the operation voltage. In the present embodiment, particularly, the detecting module 3 may detect a detecting parameter on the power supply path, and determines whether the detecting parameter is larger than a preset threshold parameter, if the detecting parameter is larger than the threshold parameter, the detecting module 3 feeds back a high power signal to the power source 1, if the detecting parameter is less than or equal to the threshold parameter, the detecting module 3 feeds back a low power signal to the power source 1, and the detecting module 3 outputs an operation voltage to the load 4.

Figure 6:
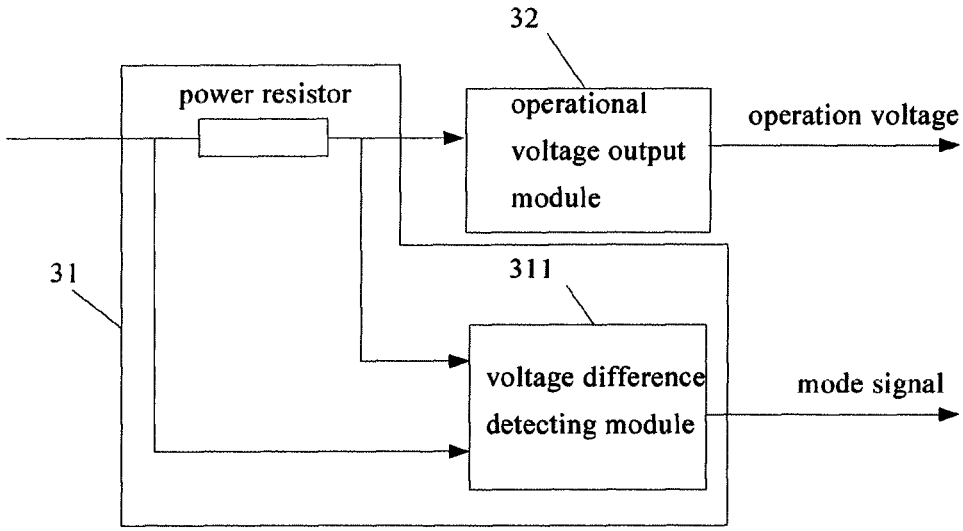
FIG. 6 is a schematic diagram of a structure of the detecting module shown in FIG. 3.

FIG. 6 is a schematic diagram of the structure of the detecting module shown in FIG. 3. As shown in FIG. 6, the detecting module 3 comprises a determining module 31 and an operation voltage output module 32, wherein the determining module 31 is connected to the power source 1, and the operation voltage output module 32 is connected to the load 4. The determining module 31 is operative to detect the detecting parameter on the power supply path, and determine whether the detecting parameter is larger than the preset threshold parameter; if the detecting parameter is larger than the threshold parameter, the determining module 31 feeds back a high power signal to the power source 1, if the detecting parameter is less than or equal to the threshold parameter, the determining module 31 feeds back a low power signal to the power source 1; the operation voltage output module 32 is operative to output an operation voltage to the load. Herein, the detecting parameter can be a current value, and the threshold parameter is a threshold current; as an alternative, the detecting parameter can be a voltage difference value, and the threshold parameter is a threshold voltage. The operation voltage can be preset as desired, and the operation voltage output module 32 outputs a uniform operation voltage whether it is in the low power mode or in the high power mode, and thus achieves the uniformity of the output voltage.

In particular, the determining module 31 may comprise a power resistor and a voltage difference detecting module 311, wherein an input terminal of the power resistor is connected to the power source 1, and an output terminal of the power resistor is connected to the operation voltage output module 32; an input terminal of the voltage difference detecting module 311 is connected to the input terminal of the power resistor and the output terminal of the power resistor respectively, and the output terminal of the voltage difference detecting module 311 is connected to the power source 1.

Optionally, in the case that the detecting parameter is a current value and the threshold parameter is a threshold current, the voltage difference detecting module 311 is operative to detect a voltage difference value between the input terminal and the output terminal of the power resistor, generate a current value according to the voltage difference value and the resistance value of the power resistor, and determine whether the current value is larger than the threshold current value, and feeds back a high power signal to the power source 1 if the current value is larger than the threshold current, if the current value is less than or equal to the threshold parameter feeds back a low power signal to the power source 1. Herein the current value is obtained from dividing the voltage difference value by the resistance value of the power resistor.

Optionally, in the case that the detecting parameter is a voltage difference value and the threshold parameter is a threshold voltage, the voltage difference detecting module 311 is operative to detect a voltage difference value between the input terminal and the output terminal of the power resistor, and determine whether the voltage difference value is larger than the threshold voltage, and feeds back a high power signal to the power source 1 if the voltage difference value is larger than the threshold voltage, if the voltage difference value is less than or equal to the threshold parameter feeds back a low power signal to the power source 1.

The power source 1 receives a mode signal fed back from the detecting module 3, outputs a power supply voltage corresponding to the mode signal according to the mode signal, and charges the charging/discharging module 2 when the mode signal is the low power signal. Herein the power supply voltage corresponding to the high power signal is less than the power supply voltage corresponding to the low power signal. Specifically, as shown in FIG. 4, if the mode signal is the low power signal, the power supply voltage corresponding to the low power signal is at a high level; as shown in FIG. 5, if the mode signal is the high power signal, the power supply voltage corresponding to the high power signal is at a low level. In a practical application, optionally, a difference value between the high level and the low level is 0.1 V. As shown in FIG. 4, when the mode signal is the low power signal, the power source 1 charges the charging/discharging module 2.

As shown in FIGS. 5 and 6, the charging/discharging module 2 is discharged to the detecting module 3 when the power source 1 outputs the power supply voltage corresponding to the high power signal, and is charged when the power source 1 outputs the power supply voltage corresponding to the low power signal; when the mode signal is the low power signal, the power supply voltage corresponding to the low power signal is larger than a charging threshold voltage, and the charging/discharging module 2 is charged; alternatively, when the mode signal is the high power signal, the power supply voltage corresponding to the high power signal is less than the charging threshold voltage, and at this time the charging/discharging module 2 is discharged to the detecting module 3. Herein the charging threshold voltage is larger than the low level and less than the high level. In the present embodiment, the charging/discharging mechanism of charging/discharging module 2 is implemented automatically, and whether charging or discharging depends on the voltage of the circuit to which the charging/discharging module 2 is connected. It needs considering the charging threshold voltage, the charging time and the charging capacity in the selection of the charging/discharging module 2. The charging threshold voltage should be arranged between the power supply voltage corresponding to the low power signal and the power supply voltage corresponding to the high power signal, and thus on the one hand it can be ensured that when the power supply circuit is in a low power mode, the power supply voltage is larger than the charging threshold voltage, and the charging/discharging module 2 enters a charging state; and on the other hand it can be ensured that when the power supply circuit is in a high power mode, the level of the circuit is less than the charging threshold voltage, and that the charging/discharging module 2 enters a discharging state, and at this time the charging/discharging module 2 can serve as a second power source of the power supply circuit. Since the longer the charging time of the charging/discharging module 2 is, the slower the operational cycle of the battery is, the existence of the charging/discharging module 2 has no meaning, and thus it is better that the charging time of the charging/discharging module 2 is as short as possible. Since the capacity of the charging/discharging module 2 has a relation to the power consumption of the display panel, generally, the larger the difference between a high peak value and a low peak value of the power consumption of the display panel, the larger the capacity of the charging/discharging module 2 needs to be set.

In the present embodiment, when the power supply circuit is in the low power mode (that is, the mode signal is the low power signal), the power source 1 charges the charging/discharging module 2; when the power supply circuit is in the high power mode (that is, the mode signal is the high power signal), the charging/discharging module 2 is discharged to the detecting module 3. When there is a dynamic change in a displayed picture, the power supply circuit switches between the high power mode and the low power mode, so that a cycle procedure comprising energy-storage, energy-release, energy-storage and energy-release of the charging/discharging module 2 can be achieved.

In the present embodiment, the cycle mechanism comprising energy-storage in the low power mode and energy-release in the high power mode is realized by use of the charging/discharging module 2, and thereby the energy requirement in the high power mode can be compensated without increasing the power of the power source 1, and in the low power mode, the power of the power source 1 would not be decreased too much, and thus it is realized that the power source 1 always operates in a stable state.

Figure 1:
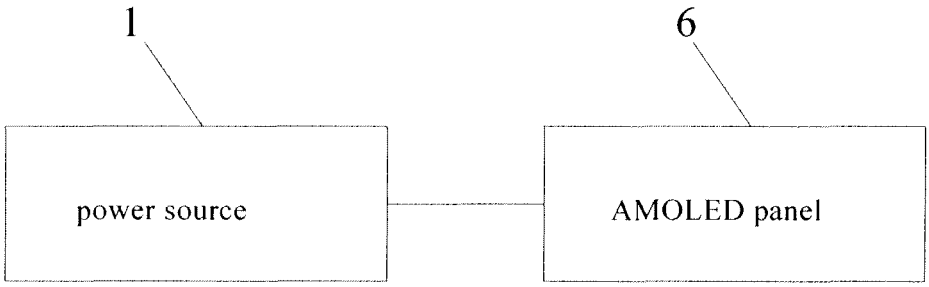
FIG. 1 is a schematic diagram of a structure of the AMOLED display apparatus in the prior art.
Figure 2:
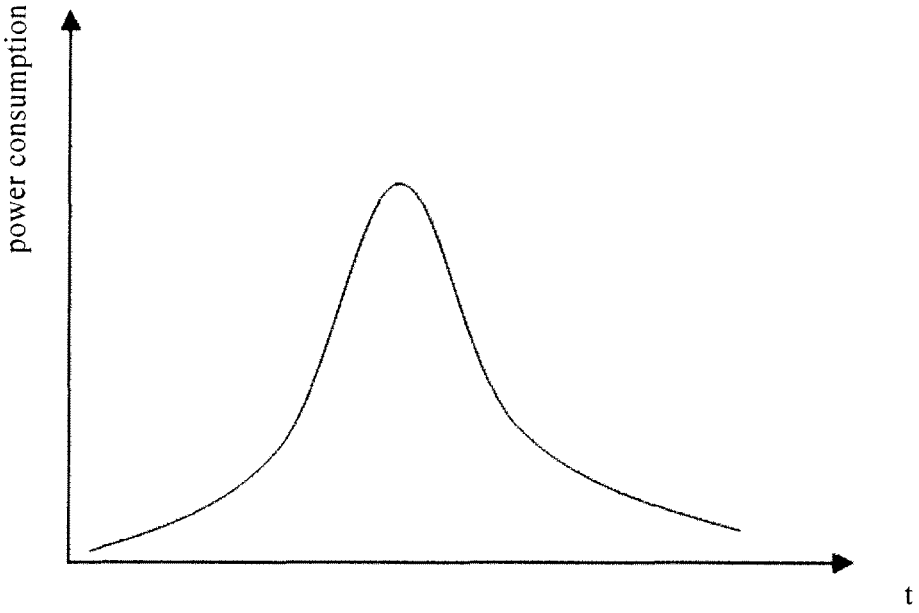
FIG. 2 is a curve diagram of the power consumption of the power source shown in FIG. 1.
Figure 7:
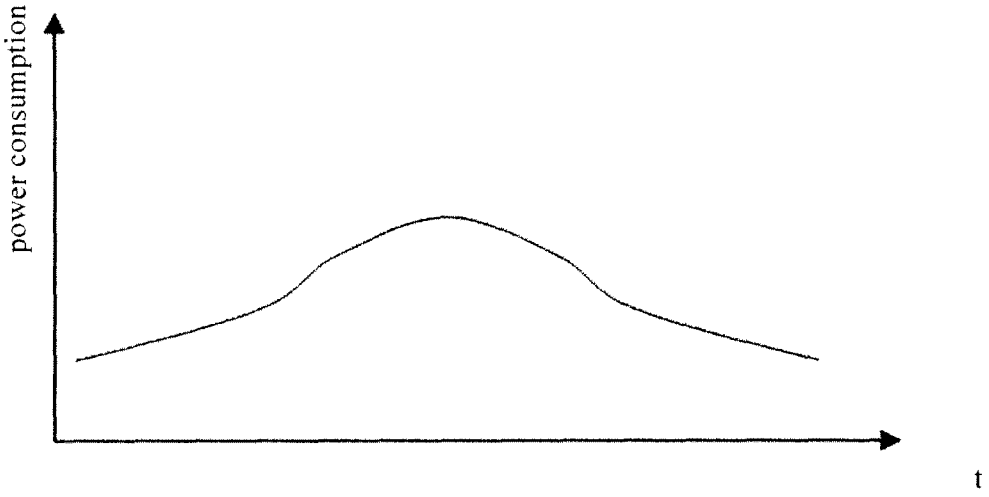
FIG. 7 is a curve diagram of the power consumption of the power source shown in FIG. 3.

FIG. 7 is a curve diagram of the power consumption of the power source shown in FIG. 3. As illustrated in FIG. 7, the power consumption of the power source 1 in the present embodiment fluctuates slightly with the change of the power consumption of the load 4, compared to the curve diagram of the power consumption of the power source in the prior art shown in FIG. 2.

In the present embodiment, the power source 1 only has a source operational mode, and does not have a sink operational mode. Thus, when the voltage output from the charging/discharging module 2 is higher than the preset voltage of the power source 1, the power source does not draw the current, and the large current phenomena that the current flows to the power source 1 never occurs.

In the present embodiment, the charging/discharging module 2 is a charging/discharging battery.

In the technical solution of the power supply circuit provided in the present embodiment, when the detecting module detects that the mode signal is the low power signal, the power source charges the charging/discharging module, and when the detecting module detects that the mode signal is the high power signal, the charging/discharging module is discharged to the detecting module, and the detecting module outputs the preset operation voltage to the load. It can be avoided effectively by means of the technical solution that the power consumption of the power source fluctuates significantly with the change of the power consumption of the load, so that the power source can operate stably, thus raising the lifespan of the power source and enhancing the EMI characteristics of the product.

Figure 8:
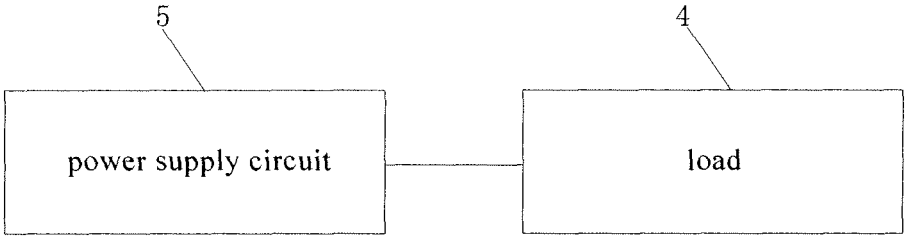
FIG. 8 is a schematic diagram of a structure of a display apparatus according to a second embodiment of the present invention.

FIG. 8 is a schematic diagram of a structure of a display apparatus according to a second embodiment of the present invention. As illustrated in FIG. 8, the display apparatus comprises a power supply circuit 5 and a load 4 connected to the power supply circuit 5. The power supply circuit 5 utilizes the power supply circuit of the first embodiment, and the detail is omitted.

In the technical solution of the display apparatus provided in the present embodiment, when the detecting module detects that the mode signal is the low power signal, the power source charges the charging/discharging module, and when the detecting module detects that the mode signal is the high power signal, the charging/discharging module is discharged to the detecting module, and the detecting module outputs the preset operation voltage to the load. It can be avoided effectively that the power consumption of the power source fluctuates significantly with the change of the power consumption of the load by means of the technical solution, so that the power source can operate stably, thus improving the lifespan of the power source and enhancing the EMI characteristics of the product.

It should be appreciated that the above embodiments are exemplary embodiments only for illustrating the principle of the present disclosure, and in no way limiting the scope of the present disclosure. It will be obvious that those skilled in the art may make modifications and variations to the above embodiments without departing from the spirit and scope of the present disclosure as defined by the following claims. Such variations and modifications are intended to be included within the scope of the present disclosure.

What is claimed is:

1. A power supply circuit comprising:

a power source for outputting a power supply voltage;

a detecting module for detecting a detecting parameter on a power supply path, feeding back a corresponding mode signal to the power source according to the detected detecting parameter, and outputting a preset operation voltage to a load, the mode signal comprising a low power signal and a high power signal;

a charging/discharging module for discharging to the detecting module when the power source outputs the power supply voltage corresponding to the high power signal, and being charged when the power source outputs the power supply voltage corresponding to the low power signal, wherein the power source is connected to the detecting module, and the charging/discharging module is connected to the power source and the detecting module respectively; and the power source receives the mode signal fed back from the detecting module, outputs the power supply voltage corresponding to the mode signal according to the mode signal, and charges the charging/discharging module when the mode signal is the low power signal.

2. The power supply circuit of claim 1, wherein the detecting module detects a detecting parameter on the power supply path, and determines whether the detecting parameter is larger than a preset threshold parameter, if the detecting parameter is larger than the threshold parameter, the detecting module feeds back the high power signal to the power source; if the detecting parameter is less than or equal to the threshold parameter, the detecting module feeds back the low power signal to the power source; and the detecting module outputs the operation voltage to the load.

3. The power supply circuit of claim 2, wherein the detecting module comprises a determining module and an operation voltage output module, the determining module is connected to the power source, and the operation voltage output module is connected to the load;

the determining module detects the detecting parameter on the power supply path, and determines whether the detecting parameter is larger than the preset threshold parameter, if the detecting parameter is larger than the threshold parameter, the determining module feeds back the high power signal to the power source; if the detecting parameter is less than or equal to the threshold parameter, the determining module feeds back the low power signal to the power source; and the operation voltage output module outputs the operation voltage to the load.

4. The power supply circuit of claim 3, wherein the determining module comprises:

a power resistor and a voltage difference detecting module, wherein an input terminal of the power resistor is connected to the power source, and an output terminal of the power resistor is connected to the operation voltage output module; an input terminal of the voltage difference detecting module is connected to the input terminal of the power resistor and the output terminal of the power resistor respectively, and the output terminal of the voltage difference detecting module is connected to the power source.

5. The power supply circuit of claim 4, wherein in a case that the detecting parameter is a current value and the threshold parameter is a threshold current, the voltage difference detecting module is operative to detect a voltage difference value between the input terminal and the output terminal of the power resistor, generate the current value according to the voltage difference value and a resistance value of the power resistor, and determine whether the current value is larger than the threshold current, feeds back the high power signal to the power source if the current value is larger than the threshold current; and feeds back the low power signal to the power source if the current value is less than or equal to the threshold parameter.

6. The power supply circuit of claim 4, wherein in a case that the detecting parameter is a voltage difference value and the threshold parameter is a threshold voltage, the voltage difference detecting module is operative to detect a voltage difference value between the input terminal and the output terminal of the power resistor, determine whether the voltage difference value is larger than the threshold voltage value, feed back the high power signal to the power source if the voltage difference value is larger than the threshold voltage value, and feeds back the low power signal to the power source if the voltage difference value is less than or equal to the threshold parameter.

7. The power supply circuit of claim 1, wherein, when the mode signal is the low power signal, the power supply voltage corresponding to the mode signal is at a high level; and when the mode signal is the high power signal, the power supply voltage corresponding to the mode signal is at a low level.

8. The power supply circuit of claim 7, wherein a difference value between the high level and the low level is 0.1V.

9. The power supply circuit of claim 7, wherein when the power supply voltage is larger than a charge threshold voltage of the charging/discharging module, the power source charges the charging/discharging module; when the power supply voltage is less than the charge threshold voltage of the charging/discharging module, the power source discharges the charging/discharging module, and the charge threshold voltage of the charging/discharging module is larger than the low level and less than the high level.

10. The power supply circuit of claim 1, wherein the charging/discharging module is a charging/discharging battery.

11. The power supply circuit of claim 1, wherein the load comprises an AMOLED panel.

12. A display apparatus comprising a power supply circuit and a load connected to the power supply circuit;

wherein the power supply circuit utilizes the power supply circuit of claim 1.

13. The power supply circuit of claim 12, wherein the detecting module detects a detecting parameter on the power supply path, and determines whether the detecting parameter is larger than a preset threshold parameter, if the detecting parameter is larger than the threshold parameter, the detecting module feeds back the high power signal to the power source; if the detecting parameter is less than or equal to the threshold parameter, the detecting module feeds back the low power signal to the power source; and the detecting module outputs the operation voltage to the load.

14. The power supply circuit of claim 13, wherein the detecting module comprises a determining module and an operation voltage output module, the determining module is connected to the power source, and the operation voltage output module is connected to the load;

the determining module detects the detecting parameter on the power supply path, and determines whether the detecting parameter is larger than the preset threshold parameter, if the detecting parameter is larger than the threshold parameter, the determining module feeds back the high power signal to the power source; if the detecting parameter is less than or equal to the threshold parameter, the determining module feeds back the low power signal to the power source; and the operation voltage output module outputs the operation voltage to the load.

15. The power supply circuit of claim 14, wherein the determining module comprises:

a power resistor and a voltage difference detecting module, wherein an input terminal of the power resistor is connected to the power source, and an output terminal of the power resistor is connected to the operation voltage output module; an input terminal of the voltage difference detecting module is connected to the input terminal of the power resistor and the output terminal of the power resistor respectively, and the output terminal of the voltage difference detecting module is connected to the power source.

16. The power supply circuit of claim 15, wherein in a case that the detecting parameter is a current value and the threshold parameter is a threshold current, the voltage difference detecting module is operative to detect a voltage difference value between the input terminal and the output terminal of the power resistor, generate the current value according to the voltage difference value and a resistance value of the power resistor, and determine whether the current value is larger than the threshold current, feeds back the high power signal to the power source if the current value is larger than the threshold current; and feeds back the low power signal to the power source if the current value is less than or equal to the threshold parameter.

17. The power supply circuit of claim 15, wherein in a case that the detecting parameter is a voltage difference value and the threshold parameter is a threshold voltage, the voltage difference detecting module is operative to detect a voltage difference value between the input terminal and the output terminal of the power resistor, determine whether the voltage difference value is larger than the threshold voltage value, feed back the high power signal to the power source if the voltage difference value is larger than the threshold voltage value, and feeds back the low power signal to the power source if the voltage difference value is less than or equal to the threshold parameter.

18. The power supply circuit of claim 12, wherein, when the mode signal is the low power signal, the power supply voltage corresponding to the mode signal is at a high level; and when the mode signal is the high power signal, the power supply voltage corresponding to the mode signal is at a low level.

19. The power supply circuit of claim 18, wherein a difference value between the high level and the low level is 0.1V.

20. The power supply circuit of claim 18, wherein when the power supply voltage is larger than a charge threshold voltage of the charging/discharging module, the power source charges the charging/discharging module; when the power supply voltage is less than the charge threshold voltage of the charging/discharging module, the power source discharges the charging/discharging module, and the charge threshold voltage of the charging/discharging module is larger than the low level and less than the high level.

* * * * *